US007001670B2

(12) United States Patent
Herbst-Dederichs

(10) Patent No.: US 7,001,670 B2
(45) Date of Patent: Feb. 21, 2006

(54) WEAR PROTECTION LAYER FOR PISTON RINGS, CONTAINING WOLFRAM CARBIDE AND CHROMIUM CARBIDE

(75) Inventor: Christian Herbst-Dederichs, Burscheid (DE)

(73) Assignee: Federal-Mogul Burscheid GmbH, (DE)

( * ) Notice: Subject to any disclaimer, the term of this patent is extended or adjusted under 35 U.S.C. 154(b) by 146 days.

(21) Appl. No.: 10/450,220

(22) PCT Filed: Nov. 17, 2001

(86) PCT No.: PCT/DE01/04336

§ 371 (c)(1),
(2), (4) Date: Dec. 4, 2003

(87) PCT Pub. No.: WO02/48422

PCT Pub. Date: Jun. 20, 2002

(65) Prior Publication Data

US 2004/0069141 A1 Apr. 15, 2004

(30) Foreign Application Priority Data

Dec. 12, 2000 (DE) ..... 100 61 750

(51) Int. Cl.
*C23C 24/00* (2006.01)
*C23C 30/00* (2006.01)
*F02F 5/00* (2006.01)

(52) U.S. Cl. ..... 428/614; 428/570; 428/665; 428/666; 428/698; 427/450; 427/455; 92/233

(58) Field of Classification Search ..... 428/614, 428/570, 665, 666, 698, 539.5; 427/450, 427/455; 92/233
See application file for complete search history.

(56) References Cited

U.S. PATENT DOCUMENTS

| | | | | |
|---|---|---|---|---|
| 3,606,359 | A | 9/1971 | McCormick | |
| 3,814,447 | A | 6/1974 | Prasse et al. | 15/18 |
| 3,837,817 | A | 9/1974 | Nakamura | 29/195 |
| 4,218,494 | A | 8/1980 | Belmondo et al. | 427/35 |
| 4,925,626 | A | 5/1990 | Anand et al. | 419/18 |
| 5,395,221 | A * | 3/1995 | Tucker et al. | 418/48 |
| 5,419,976 | A * | 5/1995 | Dulin | 428/570 |
| 5,713,129 | A | 2/1998 | Rastegar et al. | 29/888.04 |
| 5,938,403 | A * | 8/1999 | Okada et al. | 415/200 |

(Continued)

FOREIGN PATENT DOCUMENTS

| | | |
|---|---|---|
| EP | 0512805 | 5/1992 |

(Continued)

*Primary Examiner*—John J. Zimmerman
*Assistant Examiner*—Jason Savage
(74) *Attorney, Agent, or Firm*—Howard & Howard

(57) ABSTRACT

The invention relates to a wear protection layer for piston rings in internal combustion engines consisting essentially of chromium carbides, wolfram carbide, chromium and nickel. The wear protection layer is formed from a mixture of powders in which the first powder consists of at least the alloy components chromium carbide, chromium and nickel, in the form of an agglomerated and sintered powder, and which has not been subjected to any secondary heat treatment that would make the powder brittle, such as plasma refinement, the carbides in the powder having an average diameter of essentially not more than 3 $\mu$m. A second powder, also in the form of an agglomerated and sintered powder, contains wolfram carbide and is applied to at least one peripheral surface of the piston rings by thermal injection, so that two distinctive coating areas are produced in the wear protection layer. A first area, predominantly rich in chromium, and a second area, mainly rich in wolfram carbide are formed.

15 Claims, 1 Drawing Sheet

U.S. PATENT DOCUMENTS

| | | | | |
|---|---|---|---|---|
| 6,482,534 | B1 * | 11/2002 | Itsukaichi et al. | 428/569 |
| 6,562,480 | B1 * | 5/2003 | Stong et al. | 428/546 |
| 6,641,917 | B1 * | 11/2003 | Itsukaichi et al. | 428/402 |
| 6,655,181 | B1 * | 12/2003 | Morales | 72/42 |
| 6,887,585 | B1 * | 5/2005 | Herbst-Dederichs | 428/546 |

FOREIGN PATENT DOCUMENTS

| | | |
|---|---|---|
| EP | 0657237 | 12/1993 |
| EP | 0960954 | 12/1999 |
| GB | 867455 | 5/1961 |

* cited by examiner

WEAR PROTECTION LAYER FOR PISTON RINGS, CONTAINING WOLFRAM CARBIDE AND CHROMIUM CARBIDE

BACKGROUND OF THE INVENTION

1. Technical Field

The present invention relates to a protective layer for piston rings in internal combustion machines, essentially consisting of chromium carbides, tungsten carbide, chromium and nickel.

2. Related Art

The contact surfaces of piston rings in internal combustion engines are subject to wear during their use. To minimize the wear the bearing surfaces of piston rings are supplied with a protective layer. Depending on the production method utilized, it is part of background art to produce these layers by means of a high-speed flame spraying method. In this procedure the coating material, which is present as powder, is fused by means of an oxygen/fuel spray gun and sprayed onto the piston ring. EP 0 960 954A2 discloses a corresponding powder for generation of these protective layers against wear. This powder contains nickel, chromium and carbon, whereby the chromium can be present as chromium-carbide and nickel-chromium alloy. The essay "The Application of Cermet Coating on Piston Ring by HVOF" by H. Fukutome from 1995, of the Japanese piston ring manufacturer Teikoku Piston Ring, also describes the use of chromium carbides and nickel-chromium alloys for generating protective layers against wear by means of high-speed flame spraying. The alloy components used in both publications form a nickel-chromium matrix, in which depending on the alloying contribution chromium-carbides are embedded. The drawback to these coatings is that, due to their hardness and brittleness they are subject to cracks, whereby the susceptibility to cracking can even be the determining factor for the service life of the piston rings. This susceptibility to cracking results from the great carbide diameters, which, when conditioned by stress leads to carbide fractures and thus to wear on the rings. In particular in the plasma powders the carbides are present in an already decomposed form, so that the matrix embrittles and the carbide loses hardness through transformation of Cr3C2 to Cr7C3 or even to Cr23C6. To oppose this drawback, in DE 197 20 627 A1 20 to 80 Vol-% of molybdenum is mixed into the spray powder. Molybdenum possesses a relatively high viscosity and can thus stop the crack growth. The patent application discloses preferred coatings of sintered chromium-carbide and nickel chromium powders with up to 100% weight molybdenum. By means of introducing the molybdenum into the powder, however, in the resulting coating phases made of molybdenum come into being, which are roughly the size of the initial powder and as a rule have a diameter of 5 to 50 $\mu$m. The relatively low resistance to abrasion of the molybdenum has a negative effect, the molybdenum phases are preferably worn out and consequently reduce the protective layer's resistance to wear.

Along with the chromium carbides, tungsten carbides are also embedded into the matrix of the protective layer against wear. The European patent publication EP 0 512 805 B1 describes the formation of a surface protection with chromium and tungsten carbides, whereby the embedded tungsten-chromium-carbides have a particle size in the range of 25–100 $\mu$m. Tungsten carbides are harder than chromium carbides and possess a very high resistance to wear and pressure. The extraordinarily hard tungsten carbides, however, show a significant disadvantage in the processing of the produced surface. The surface can no longer be finished with conventional grinding wheels, processing is only possible with very high-quality and at the same time expensive grinding wheels.

BRIEF SUMMARY OF THE INVENTION

The invention is based on the object of overcoming the disadvantages that are part of the state of the art and producing a protective layer against wear that is nearly crack-free and possesses a high resistance to wear.

BRIEF DESCRIPTION OF THE DRAWINGS

These and other features and advantages of the present invention will become more readily appreciated when considered in connection with the following detailed description and appended drawing, wherein.

Figure 1:
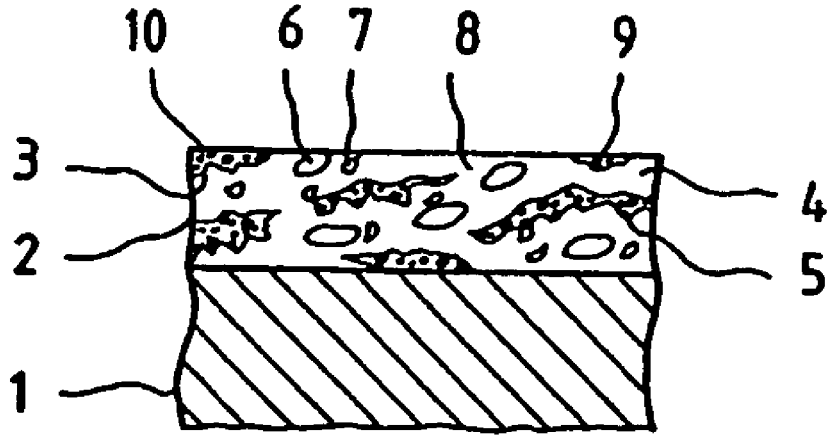
FIG. 1 is an enlarged cross-sectional fragmentary view of a piston ring according to the invention.

The invention's protective layer against wear for the contact surface of the piston ring is formed of a powder mixture in which the first powder exists as agglomerated and sintered powder made out of the alloy components chromium carbide, chromium and nickel, which has not experienced any subsequent embrittling heat treatment such as e.g. a plasma age hardening, whereby the carbides in the powder have a mean diameter that is essentially not greater than 3 $\mu$m and a second powder that is also present as an agglomerated and sintered powder and contains tungsten carbide as an essential characteristic and is applied to at least one peripheral area of the piston rings by means of thermal spraying, so that two differing layer areas are produced in the protective layer against wear and tear, whereby a first area develops that is primarily rich in chromium carbide and a second area develops that is chiefly rich in tungsten carbide.

The use of a powder with a carbide size of less than 3 $\mu$m is a significant difference to the conventionally used powders, whose mean carbide size is over 5 $\mu$m, mostly however even above 10 $\mu$m. By reducing the carbide size, the carbide outbreak is lowered, the risk of cracking is minimized and at the same time the internal stresses in the carbide are reduced, which in turn lowers the carbide shattering tendency. A further significant difference is the use of primary carbides in the initial powder, which are predominantly present as Cr3C2 and Cr7C3 carbides. The powder gained by means of the conventional fusion spraying on the other hand have mostly dendritic carbides and predominantly dissolved carbides such as for example Cr23C6, which are very much softer.

DETAILED DESCRIPTION OF THE INVENTION

In accordance with the invention two different layer areas develop as the basis in the protective layer against wear and tear. The layer structure is disordered. For example a matrix out of nickel, chromium and molybdenum forms the first layer area, into which homogenous and finely distributed chromium carbides and molybdenum phases are embedded. In contrast to the 5 to 50 $\mu$m large molybdenum phases known from the state of the art, the molybdenum phases are only present in a size of below 5 $\mu$m, so that there are no wear increasing phases present in the matrix.

In the second visibly differing layer area predominately tungsten and chromium carbides are embedded in the nickel matrix. The tungsten carbides have a diameter that is basically less than 1.5 μm and the chromium carbides have a diameter that is basically less than 3 μm, by means of which the metal cutting is supported. A ratio corresponding to this layer structure could for example consist of 2 parts areas rich in tungsten carbide and 8 parts areas rich in chromium carbide. Experiments in real internal combustion engines have shown that a protective layer against wear and tear on piston rings developed in accordance with this example has a complete freedom from cracks and a wear behavior that is nearly comparable with galvanically produced layers.

By means of the superimposition of the two layer materials in a protective layer against wear it is now possible to combine the relatively good machinability of the chromium carbides with the very high resistance to wear of the tungsten carbides. One advantage resulting from this is the fact that machining at full freedom from cracks is possible without problems with conventional grinding wheels, that is, finishing is not more cost-intensive than with a conventional protective layer against wear and tear created by today'' plasma spraying techniques.

The cobalt components in the alloy serve in particular as a binding agent in the areas that are rich in tungsten carbide. The hard material phases chromium carbide and tungsten carbide are the carriers of the hardness and determine among other things the wearing properties, while the auxiliary metal gives the protective layer against wear its toughness.

A protective layer against wear for a piston ring of an internal combustion machine in accordance with the invention is represented in the sole drawing FIG. 1 using an embodiment and will be described in greater detail in the following.

FIG. 1 shows a longitudinal cross section through a protective layer against wear and tear on a piston ring. In FIG. 1 a protective layer against wear and tear 2 is applied to a piston ring 1. The bounds 3 in the protective layer against wear and tear 2 mark the different layer areas 4 and 5. Layer area 4 contains primarily chromium carbide rich phases 6 and molybdenum phases 7, the matrix 8 consists chiefly of nickel and chromium. Layer area 5 in this embodiment also has a nickel chromium matrix, in which mainly tungsten carbides 9 and chromium carbides 10 are embedded.

The second powder includes chromium, carbon and nickel, so that during spraying, areas rich in tungsten carbide result, in which primarily tungsten carbides, chromium carbides and nickel are present.

The alloy components in the areas that are rich in tungsten carbides are present with weight percentages of carbon between 8–11%, nickel between 6–8%, chromium between 18–24%, with the balance essentially tungsten.

The second powder may alternatively include cobalt and chromium so that during thermal spraying, areas rich in tungsten carbide result, in which primarily tungsten carbides are present in a cobalt chromium alloy. Preferably, the cobalt in such alloy is present in an amount between 6–18 wt. %, chromium is present in an amount between 0.1–9 wt. % and the balance is essentially tungsten.

The alloy components of the first powder are present with weight percentages of carbon between 4–6%, nickel between 11–18% with the balance essentially tungsten.

The areas rich in chromium carbide may additionally include molybdenum, with carbon being present in an amount of 7–10 wt. %, nickel between 10–20 wt. %, molybdenum between 1–10 wt. % and the balance essentially tungsten.

The areas rich in tungsten carbide preferably range between 1–95 vol. %. The tungsten carbides are not greater than 1.5 μm. The tungsten carbides are present as WC carbides and as modifications of the tungsten carbides.

The chromium carbides do not exceed a mean diameter 8 μm.

The preferred thermal spray technique is high speed flame spraying, such as HVOF.

What is claimed is:

1. Piston ring for internal combustion machines, with a protective layer against wear applied to at least one peripheral area of the piston rings by means of thermal spraying the protective layer, the protective layer consisting essentially of chromium carbide in phases, tungsten carbide in phases, chromium and nickel, characterized by the fact that the protective layer is formed prior to thermal spraying by a mixture of a first powder and a second powder, wherein the first powder exists as agglomerated and sintered powder made out of at least the alloy components chromium carbide, chromium and nickel, which has not experienced any subsequent embrittling heat treatment, and wherein the chromium carbide in the first powder has a mean diameter grain size smaller than 3 μm, and the second powder comprises an agglomerated and sintered powder containing tungsten carbide, whereby the protective layer as applied by thermal spraying results in a first area developed by the first powder in which phases of chromium carbide are suspended in a chromium and nickel matrix and a second area developed by the second powder in which phases of tungsten carbide are suspended in a matrix, the first and second areas being separated by a discrete boundary.

2. Piston ring according to claim 1, wherein the second powder additionally includes chromium, carbon and nickel, so that during thermal spraying the second area will develop tungsten carbide in phases, chromium carbide in phases and nickel.

3. Piston ring according to claim 1, wherein the second area includes weight percentages of carbon between 8 and 11%, between 6 and 8% in nickel, between 18 and 24% in chromium and the rest in tungsten.

4. Piston ring according to claim 1, wherein the second powder additionally includes nickel, so that after thermal spraying, nickel will be present in the second area.

5. Piston ring according to claim 1, wherein the alloy components in the second area consist essentially of weight percentages of carbon between 4 and 6%, between 11 and 18% in nickel, and the rest in tungsten.

6. Piston ring according to claim 1, wherein the second powder additionally includes cobalt and chromium, so that after thermal spraying, a cobalt chromium alloy will be present in the second area.

7. Piston ring according to claim 6, wherein the alloy components in the second area consist essentially of weight percentages of cobalt between 6 and 18%, between 0.1 and 9% in chromium, and the rest in tungsten.

8. Piston ring according to claim 1, wherein the first area includes molybdenum.

9. Piston ring according to claim 8, wherein the first area consists essentially of between 7 and 10 weight % carbon, 10–20% nickel, 1–10% molybdenum and the rest in chromium.

10. Piston ring according to claim 1, wherein the percentage of tungsten carbide within the matrix of the second area consists essentially of between 1 and 95 Vol. %.

11. Piston ring according to claim 8, wherein the molybdenum is present in phases in the first area, and wherein the diameter of the molybdenum phases are generally not greater than 5 μm.

12. Piston ring according to claim 1, wherein the tungsten carbide phases in the second area are not greater than 1.5 μm.

13. Piston ring according to claim 1, wherein the tungsten carbide phases in the second area are present carbides and as modifications of the tungsten carbide alloyed with a metal.

14. Piston ring according to claim 1, wherein the chromium carbide phases are present in the first area as Cr3C2.

15. Piston ring according to claim 1, wherein the protective layer is applied by a high speed flame spraying method (HVOF) as the thermal spraying technique.

* * * * *

UNITED STATES PATENT AND TRADEMARK OFFICE

CERTIFICATE OF CORRECTION

PATENT NO. : 7,001,670 B2
APPLICATION NO. : 10/450220
DATED : February 21, 2006
INVENTOR(S) : Christian Herbst-Dederichs It is certified that error appears in the above-identified patent and that said Letters Patent is hereby corrected as shown below:

| Column | Line | |
|---|---|---|
| 5 | 7 | Delete "carbides and" |

Signed and Sealed this

Thirteenth Day of February, 2007

JON W. DUDAS
*Director of the United States Patent and Trademark Office*